United States Patent [19]

Yonezawa

[11] 4,301,673

[45] Nov. 24, 1981

[54] DIE LIFTER UNIT

[76] Inventor: Keitaro Yonezawa, 14, Aza Hattanda, Hama, Amagasaki, Hyogoken, Japan

[21] Appl. No.: 108,952

[22] Filed: Dec. 31, 1979

[51] Int. Cl.[3] ..... B21J 13/00

[52] U.S. Cl. ..... 72/448; 100/918

[58] Field of Search ..... 72/446, 448, 447; 100/DIG. 18, 229 R, 224

[56] References Cited

U.S. PATENT DOCUMENTS 3,111,100 11/1963 Georgeff ..... 100/229 R
3,139,676 7/1964 Grover ..... 100/DIG. 18
4,152,978 5/1979 Abe ..... 72/446

FOREIGN PATENT DOCUMENTS 844857 6/1970 Canada ..... 72/448

*Primary Examiner*—Gene P. Crosby
*Attorney, Agent, or Firm*—Bacon & Thomas

[57] ABSTRACT

The bolster of a pressing or punching machine is provided with a hydraulic die lifter unit having a hydraulic system in itself, the die lifter unit including rollers adapted to allow a die to transport smoothly thereon, and being floatably fitted in a groove on the top surface of the bolster.

12 Claims, 18 Drawing Figures

DIE LIFTER UNIT

BACKGROUND OF THE INVENTION

1. Field of the Invention:

This invention relates to a hydraulic die lifter unit for use in a pressing or punching machine. More particularly, the invention relates to a die lifter unit floatably fitted in the bolster of the machine, wherein the die lifter unit includes rollers adapted to allow a die to transport smoothly thereon, and also includes a hydraulic system for raising itself independently of the bolster.

2. Description of the Prior Art:

In a pressing or punching machine a molding or punching die is frequently dismounted from the bolster for replacement or repair, but because of its heavy weight, it is not an easy work, requiring a special tool, such as a crane. In order to lessen this toil, it has been proposed that the bolster be provided with a die lifter hydraulically floatable in a groove in the top surface of the bolster, wherein the die lifter has a plurality of rollers adapted to allow the die to roll thereon smoothly for dismount or mount. When the die lifter is raised under hydraulic pressure, the rollers rise up above the top surface of the bolster, thereby facilitating the transport of the die thereon. In this prior art die-lifter the hydraulic cylinder and oil path are provided within the bolster, which requires that the bolster is subjected to boring operation. However, as commonly known, the bolster is made of a thick metal block, and accordingly the boring is a difficult, expensive work.

SUMMARY OF THE INVENTION

The present invention is directed toward solving the problem pointed out above, and has for its object to provide an improved die lifter unit permitting of easy incorporation in the bolster of a pressing or punching machine. Another object of the present invention is to provide an improved die lifter unit capable of trouble-free maintenance.

Other objects and advantages of the present invention will be obvious to one skilled in the art from the following description and drawings.

According to the present invention, the die lifter unit includes a long, narrow bar-shaped body adapted to be floatably fitted in a groove on the top surface of the bolster of a pressing or punching machine, wherein the bar-shaped body has a depression on its top surface for carrying rollers therein, and also has a hydraulic system for raising itself under hydraulic pressure.

According to another aspect of the present invention, the die lifter unit is provided with an auxiliary carrier unit pivotally connected to the bolster, the carrier unit including rollers which allow a die to transport smoothly to or from the die lifter unit.

DETAILED DESCRIPTION OF THE INVENTION

Figure 1:
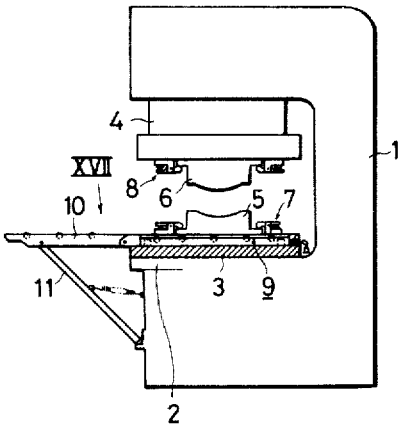
FIG. 1 is an overall side view of a pressing machine and a die lifter unit constructed in accordance with the present invention.
Figure 4:
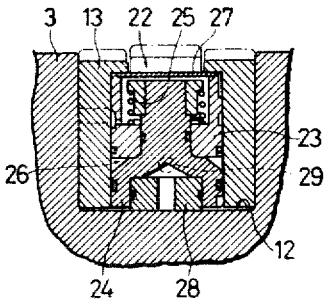
FIGS. 4 and 5 are cross-sections of the die lifter unit in FIG. 2, taken along the lines IV—IV and V—V therein, respectively.
Figure 5:
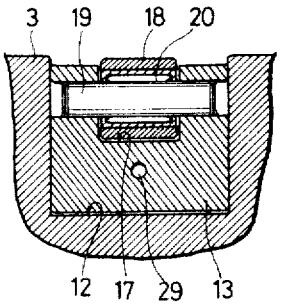
Figure 6:
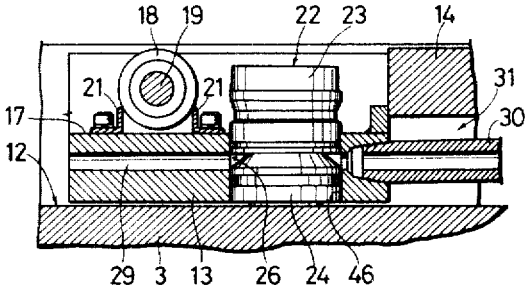
FIG. 6 is a cross-sectional side view of a main section of the die lifter unit.

Referring to FIG. 1, a pressing machine 1 includes a bed 2 in its base section, on which a bolster 3 is fixedly mounted. The machine 1 includes a ram 4 in its upper section, which is adapted to lower and rise under a known hydraulic system. The bolster 3 is provided with a first die 5, and the ram 4 is provided with a second die 6, wherein these dies are fixed thereto by means of hydraulic clamps 7 and 8, respectively. A die lifter unit constructed in accordance with the present invention, generally denoted by reference numeral 9, is floatably fitted in the bolster. The die lifter unit 9 includes a hydraulic system for raising itself so as to allow its rollers to rise up above the top surface of the bolster. The bed 2 is provided with an auxiliary carrier unit 10 supported by a leg 11, which is adapted to be placed in abutment with the bed 2.

Figure 2:
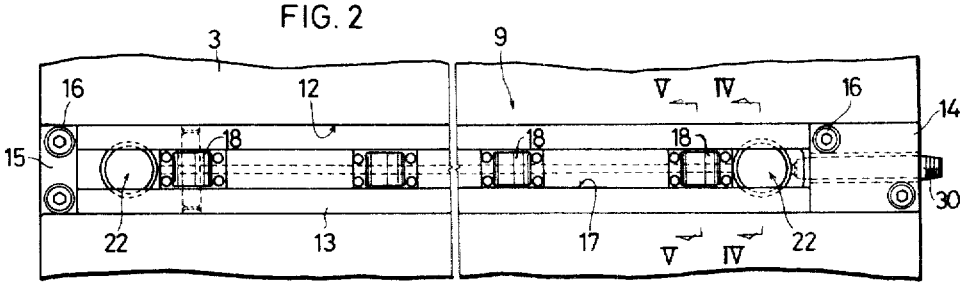
FIG. 2 is a plan view of the die lifter unit in FIG. 1.
Figure 3:
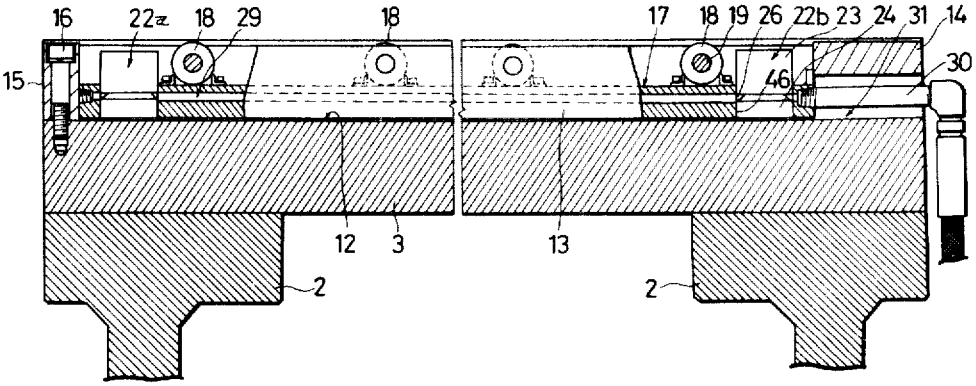
FIG. 3 is a vertical cross-section through the die lifter unit in FIG. 2.

Referring to FIGS. 2 to 6, a first example of the die lifter unit will be explained:

As best illustrated in FIGS. 2 and 3, the bolster 3 has a groove 12 in its top surface, the groove being of rectangular section and extending from one end to the other of the bolster. The die lifter unit 9 includes a long, narrow bar-shaped body 13 of rectangular section, which is floatably fitted in the groove 12 of the bolster. In this specification, the "float" means that the die lifter unit as a whole rises up under its own hydraulic system in the groove 12, independently of the bolster 3. However, the die lifter unit is prevented from lengthwise displacement in the groove 12 by stop members 14 and 15 each secured to the bolster by means of bolts 16.

The lifter body 13 (hereinafter referred to merely as the body) includes a depression; in the illustrated embodiment, a groove 17 in its top surface along the entire length, in which rollers 18 are carried on spindles 19 through needle roller-bearings 20 (FIG. 5), such that the top periphery of each roller projects above the top surface of the body 13, but not above the top surface of the bolster 3. Each roller is provided with scrapers 21 (FIG. 6) adapted to remove dirt and oil sticking to its peripheral surface.

As best illustrated in FIGS. 2 and 3, the body 13 includes a pair of hydraulic cylinders 22, which are housed in bores 46 formed in the end sections of the body. The cylinder 22 includes a piston 24, a cylinder head 23 having a cap 27, and a ring-shaped oil chamber 26 defined by the piston, the cylinder head and the inside wall of the bore 46. The piston 24 is provided with a spring 25 for allowing the cylinder head 23 to return to its original position when the oil is withdrawn from the oil chamber 26. The height of the piston 24 can be adjusted by replacement of an adjuster member 28, whereby the lower limit attainable by the body 13 is determined. The adjuster member 28 may be provided with threads on its outer surface, thereby permitting of ready engagement with the piston. After adjustment, the adjuster member is locked.

The body 13 includes an oil path 29 extending from one end to the other thereof, which communicates with the ring-shaped oil chambers 26 of the cylinders 22. Oil is introduced into the oil path 29 through an oil duct 30, which also permits of its discharge therefrom. The oil duct 30 is carried on the body 13, so that it moves up and down together with the body 13. A space 31 produced in the top member 14 permits of this movement of the oil duct. The oil duct is supplied with oil from a pump (not shown).

When the die 5 or 6 is to be dismounted or mounted, oil is introduced into the ring-shaped oil chambers 26 of each cylinder 22 through the oil duct 30 and oil path 29 by means of the pump (not shown). The cylinder head 23 rises against the action of the coil spring 25 under the hydraulic pressure in the oil chamber 26, thereby causing the body 13 to float as a unit. When the body is raised to its highest, the top periphery of each roller project above the top surface of the bolster 3. Thus, the die is ready to roll on the rollers 18 of the body, thereby facilitating the transport of the die.

Figure 7:
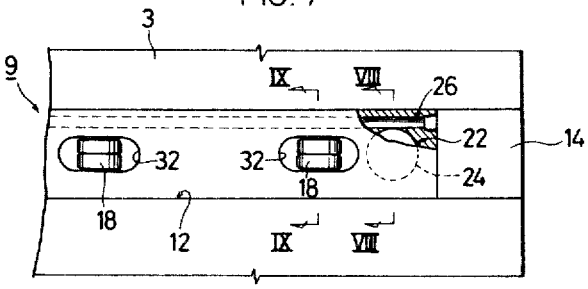
FIG. 7 is a plan view of a modified embodiment of the die lifter unit.
Figure 8:
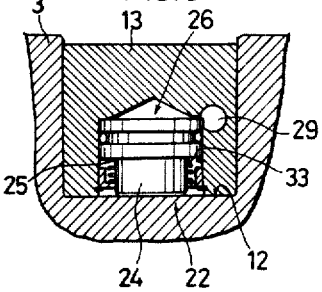
FIGS. 8 and 9 are cross-sections of the embodiment in FIG. 7, taken along the lines VIII—VIII and IX—IX therein, respectively.
Figure 9:
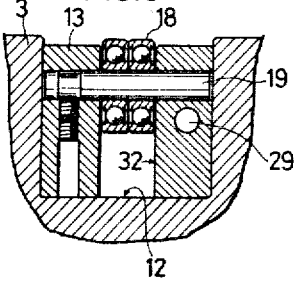

Referring to FIGS. 7 to 9, the illustrated embodiment is a modified version of the roller arrangement. In this version, each roller 18 is provided in its own trench 32, which is produced instead of the groove 17. A hydraulic cylinder 22 is provided in a blind bore 33, which is open only in the bottom of the body 13 and in this embodiment no cylinder head is provided. The body 13 is raised directly under a counterflow pressure against the piston 24 when oil is introduced into an oil chamber 26 through an oil path 29. Because of non-use of a cylinder head, the structure of the hydraulic cylinder is simplified.

Figure 10:
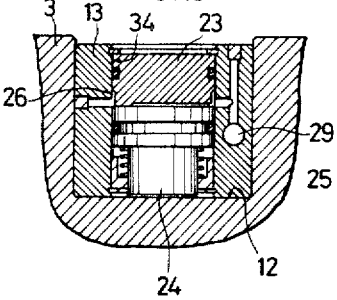
FIG. 10 is a vertical cross-section of a further modified embodiment.

Referring to FIG. 10, this version has a bore 34 passed through a body 13, and has a cylinder head 23, a piston 24, a coil spring 25 and an oil chamber 26 in the bore 34. When oil is introduced in the oil chamber 26, the cylinder head 23 rises up under a counterflow pressure against the piston 24, thereby enabling the body 13 to rise up.

Figure 11:
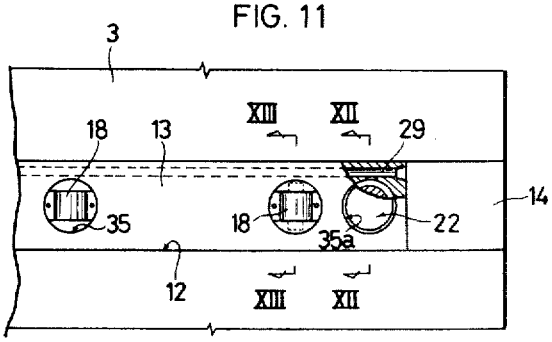
FIG. 11 is a plan view of another modified embodiment.
Figure 13:
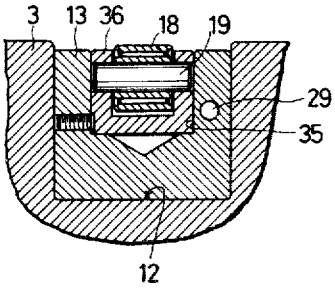

Referring to FIGS. 11 and 13, this version has a plurality of bores 35 in which rollers 18 are carried by brackets 36 having spindles 19. In addition, the body has a pair of bores **35*a* of the same diameter as that of the bore 35, wherein each bore 35*a* passes through the body 13. A hydraulic cylinder 22 is provided in the bore 35*a*, which includes a cylinder head 23, a piston 24, an oil chamber 26 and a spring 25 in the described manner. When oil is introduced into the oil chamber 26 through an oil path 29, the cylinder head 23 is raised against the coil spring 25, thereby enabling the body 13** to rise up.

Figure 14:
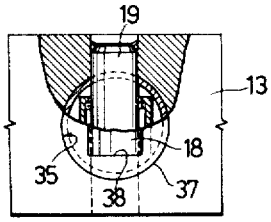
FIG. 14 is a partially broken plan view of a further modified embodiment.
Figure 15:
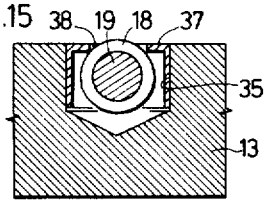
FIG. 15 is a cross-sectional front view of the embodiment in FIG. 14.
Figure 12:
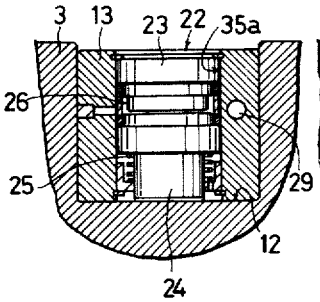
FIGS. 12 and 13 are cross-sections of the embodiment in FIG. 11, taken along the lines XII—XII and XIII—XIII therein, respectively.
Figure 16:
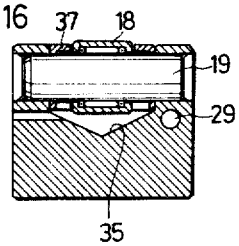
FIG. 16 is a cross-sectional side view of the embodiment in FIG. 14.

Referring to FIGS. 14 to 16, this embodiment has a modified version of the roller arrangement illustrated in FIGS. 11 to 13. Each roller 18 is provided with a cover 37 having a rectangular slit 38 through which part of its periphery is exposed. The roller 18 and the cover 37 are carried on the same spindle 19, and are supported on the body 13.

In the embodiments described above, a pair of hydraulic cylinders 22 are employed, but the number is not limited to two. It can be determined in accordance with the length of the body, and the weight of the die.

Figure 17:
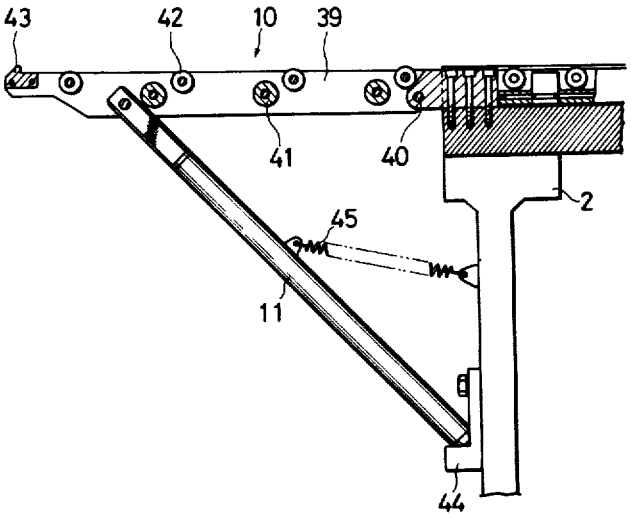
FIG. 17 is a side view on an enlarged scale of an auxiliary carrier unit, particularly showing the portion indicated by XVII in FIG. 1.
Figure 18:
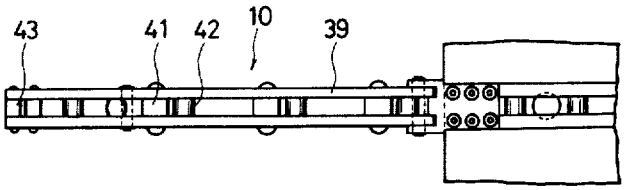
FIG. 18 is a plan view of the auxiliary carrier unit of FIG. 17.

Referring to FIGS. 17 and 18, the auxiliary carrier unit 10 will be explained:

The auxiliary carrier unit 10 includes a conveyor 39 pivotally connected to the member 15 by means of a pivot 40, and a leg 11 whose upper end is pivotally connected to the conveyor 39. Its lower free end is placed on a metal piece 44 fastened to the bed 2. The conveyor 39 is provided with spindles 41 and rollers 42, and is additionally provided with a stop 43 at its terminating end. The stop 43 is adapted to prevent the rolling die from falling off the conveyor 39.

When the leg 11 is disposed as shown in FIG. 17, the conveyor 39 is disposed horizontally with the top surfaces of the rollers 42 being on the same level as those of the rollers 18 when the body 13 is raised to its highest. When the leg 11 is so disposed, the lower end of the leg 11 is firmly abutted with the metal piece 44 under the tension of a spring 45, and is prevented from dislocating therefrom. When folded, the lower end of the leg 11 is disconnected from the metal piece 44 by hand, and the conveyor 39 is rotated around the pivot 40 in the counterclockwise direction in FIG. 17. When the carrier unit 10 is not used, the conveyor 39 is kept alongside the bed 2. In the described embodiment the conveyor 39 is horizontally kept by means of the leg 11 whose lower end is placed in abutment with the bed, but the conveyor can be placed into a working position by a hydraulic system, or by an extendable threaded rod.

As is evident from the foregoing, the die lifter unit of the present invention includes a hydraulic system in itself, not in the bolster like the known die lifter unit. This can dispense with the boring work on the bolster, which is constructed of a thick metal block. Instead, it is only necessary to cut a groove on the top surface of the bolster for accommodating the die lifter unit therein. This is no difficult or expensive work. In addition, the maintenance is easy because of its unified structure.

What is claimed is:

1. A die lifter unit for use in a press, said unit comprising:

a bar-shaped body having a depression on its top surface;

a plurality of rollers carried in said depression;

a pair of hydraulic cylinders provided in said body;

said hydraulic cylinders being connected to each other through an oil path lengthwisely produced in said body;

said oil path being communicated with an oil supply; and said body being floatably provided in a groove on the top surface of the bolster of said press.

2. A die lifter unit as set forth in claim 1, wherein the bar-shaped body has a rectangular section, and wherein the depression is a groove in said body of rectangular section, said groove extending from one end to the other said body.

3. A die lifter unit as set forth in claim 1, wherein each hydraulic cylinder is provided in a bore which is open in the bottom of said bar-shaped body, said hydraulic cylinder including a cylinder head, a piston, and an oil chamber defined by said cylinder head, said piston and the inside wall of said bore, said cylinder head being adapted to rise under hydraulic pressure in said oil chamber.

4. A die lifter unit as set forth in claim 1, wherein the depression consists of a corresponding number of holes to said rollers.

5. A die lifter unit as set forth in claim 1, wherein the hydraulic cylinder is provided in a blind hole opening through the bottom of said bar-shaped body, and includes a piston and an oil chamber defined by said piston and the top of said blind hole, thereby enabling said body to rise up under the hydraulic pressure in said oil chamber.

6. A die lifter unit as set forth in claim 1, wherein each roller consists of a set of bearings arranged side by side on a spindle.

7. A die lifter unit as set forth in claim 1, wherein each hydraulic cylinder is provided in a bore passed through said bar-shaped body, and includes a piston, an oil chamber and a cylinder head respectively from the bottom of said body, said piston being provided with a coil spring to assist in bringing said cylinder head to rest at its original position when oil is withdrawn from said oil chamber.

8. A die lifter unit as set forth in claim 5, wherein the depression consists of a corresponding number of blind holes to said rollers, and wherein each of the rollers is mounted on a bracket fitted in said each blind hole.

9. A die lifter unit as set forth in claim 5, wherein the depression consists of a corresponding number of blind holes to said rollers, and wherein the rollers are provided with covers having slits through which part of the peripheral surface of said each roller is exposed.

10. A die lifter unit as set forth in claim 1, further comprising an auxiliary carrier unit pivotally connected to the bolster of said press, said carrier unit including a conveyor having rollers arranged on the same level as said rollers of said die lifter unit, and a supporting means whose one end is pivotally connected to said conveyor.

11. A die lifter unit as set forth in claim 1, wherein the bolster of the press is provided with stop members at each end of said groove for preventing said bar-shaped body from lengthwise displacement therein, said stop members being fastened to said bolster.

12. A die lifter unit as set forth in claim 11, further comprising an auxiliary carrier unit pivotally connected to said stop member located in the front of said machine, said carrier unit including a conveyor having rollers arranged on the ame level as said rollers of said bar-shaped body, and also including a supporting leg pivotally connected to said conveyor.

* * * * *